US006386915B1

(12) United States Patent
Nelson

(10) Patent No.: US 6,386,915 B1
(45) Date of Patent: May 14, 2002

(54) ONE STEP CONNECTOR

(75) Inventor: James Nelson, Cheshire, CT (US)

(73) Assignee: Radio Frequency Systems, Inc., Marlboro, NJ (US)

( * ) Notice: Subject to any disclaimer, the term of this patent is extended or adjusted under 35 U.S.C. 154(b) by 0 days.

(21) Appl. No.: 09/712,073

(22) Filed: Nov. 14, 2000

(51) Int. Cl.[7] ..... H01R 9/05
(52) U.S. Cl. ..... 439/584; 439/583
(58) Field of Search ..... 439/584, 585, 439/583, 582, 581, 580, 579, 578, 98; 174/88 C, 75 C

(56) References Cited

U.S. PATENT DOCUMENTS

| | | | | |
|---|---|---|---|---|
| 3,170,748 A | | 2/1965 | Horssen | |
| 3,384,860 A | | 5/1968 | Schaefer et al. | |
| 3,448,430 A | | 6/1969 | Kelly | |
| 3,739,076 A | | 6/1973 | Schwartz | |
| 3,907,399 A | | 9/1975 | Spinner | |
| 3,910,673 A | | 10/1975 | Stokes | |
| 3,985,418 A | | 10/1976 | Spinner | |
| 4,046,451 A | * | 9/1977 | Juds et al. | 439/583 |
| 4,273,405 A | | 6/1981 | Law | |
| 4,580,865 A | | 4/1986 | Fryberger | |
| 4,687,272 A | | 8/1987 | Spinner et al. | |
| 4,761,146 A | | 8/1988 | Sohoel | |
| 5,046,964 A | | 9/1991 | Welsh et al. | |
| 5,284,449 A | | 2/1994 | Vaccaro | |
| 5,352,134 A | | 10/1994 | Jacobsen et al. | |
| 5,518,420 A | | 5/1996 | Pitschi | |
| 5,561,900 A | | 10/1996 | Hosler, Sr. | |
| 5,766,037 A | | 6/1998 | Nelson | |
| 5,857,872 A | | 1/1999 | Tettinger | |
| 5,938,474 A | | 8/1999 | Nelson | |
| 5,984,723 A | * | 11/1999 | Wild | 439/583 |
| 6,032,358 A | | 3/2000 | Wild | |
| 6,089,912 A | * | 7/2000 | Tallis et al. | 439/584 |

* cited by examiner

*Primary Examiner*—Brian Sircus
*Assistant Examiner*—Chandrika Prasad
(74) *Attorney, Agent, or Firm*—Sughrue Mion, PLLC

(57) ABSTRACT

This invention relates to a one step coaxial connector for an annular corrugated coaxial cable. The components of the connector include an outer conductor clamping back nut, a collet and a body. The collet (1) enhances electrical performance by providing a full 360 degree contact with the outer conductor. In addition, an O-ring is used to provide a seal between the back nut and outer conductor of the cable. When the back nut (2) is screwed into the body (5), the collet (1) is forced further into the interior portion (11) of the connector body (5). The resilient fingers of the (1) collet are forced to close radially around the first corrugation groove (3) of the cable's outer conductor. In addition, an O ring (4), that initially resides in a cavity (12) created by the collet (1) and the back nut (2), is forced into a corrugation groove of the cable's outer conductor. A bore (6) on the back nut (2) provides the proper diameter to compress the O-ring (4) to provide a tight seal.

29 Claims, 1 Drawing Sheet

ONE STEP CONNECTOR

FIELD OF INVENTION

This invention is related to the field of connectors. More particularly, this invention relates to a coaxial connector for an annular corrugated coaxial cable which can be installed in the field without special tools.

BACKGROUND OF INVENTION

Currently existing one piece connectors present certain problems. U.S. Pat. No. 6,809,964 discloses a connector which uses ball bearings that engage a corrugation groove of the cable's outer conductor. However, the ball bearings do not make a 360 degree contact. Therefore, passive intermodulation (PIM) performance can be degraded. Also, although it uses an O-ring, the O-ring doesn't engage the corrugation groove. Instead it seals on the crest of a corrugation, that can be subjected to damage when the jacket is removed. Lastly, a special tool is required to trim the cable before the connector can be installed.

Another connector made by Spinner must be installed in a multistep operation. First, the O-ring must be installed. Next, the connector is placed over the corrugated shield and O-ring of the corrugated cable. In addition, the O-ring must be compressed by hand pressure as the connector is installed. This limits the amount of squeeze the O-ring can be compressed. Finally, the Spinner connector uses a non-standard tool called a spanner wrench for large size connectors.

SUMMARY OF THE INVENTION

The present invention is a one step connector, comprising a body, having a first end with a threaded interior portion which mates with a back nut having a threaded exterior portion. In addition, it comprises a collet having resilient fingers and an oversized O-ring. The body further comprises a taper between its base and side for closing the resilient fingers radially by pressing on an end of the resilient fingers. Located midway on the resilient fingers is a ramp which makes contact with an interior surface of the back nut to also aid in closing the resilient fingers. Furthermore, the back nut comprises a bore which compresses the O-ring when the connector is being clamped to a cable. In addition, the back nut includes a shoulder to provide rigidity to the collet by engaging a tab of the collet.

In another preferred embodiment, the present invention is a coaxial cable assembly comprising the one step connector and a RF coaxial cable having an annular corrugated outer conductor, a center conductor and a dielectric material located between the outer conductor and the center conductor.

In still another preferred embodiment, the present invention is a method of sealing a connector to a cable. When a backnut is screwed into a body, a collet is collapsed around a first corrugation groove of a cable's jacket. In addition, a lubricated O-ring is pushed by resilient fingers of the collet out of a cavity into a corrugation groove in the cable's outer conductor. Furthermore, the O-ring is compressed by a bore located on the backnut.

DETAILED DESCRIPTION OF THE INVENTION

Figure 1:
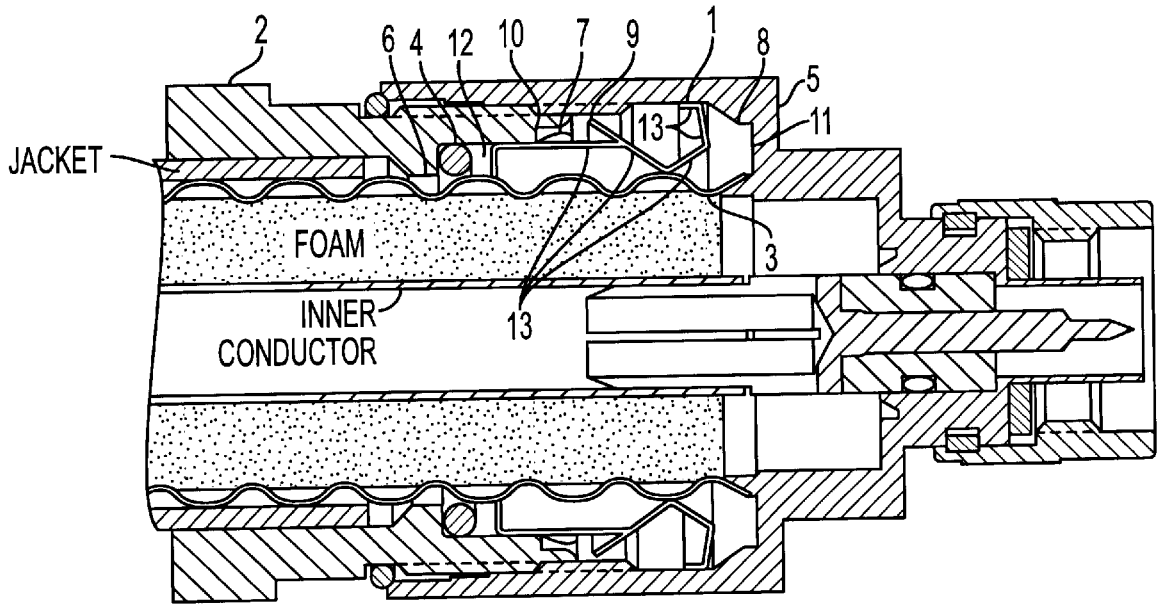
FIG. 1 is a view of the one step connector in the "as supplied" condition ready to be clamped onto the coaxial cable.

This invention relates to a coaxial connector for an annular corrugated coaxial cable. In addition, it relates to a method for attaching a connector to the outer conductor of an annular corrugated coaxial cable without installing extra parts. Therefore, extra parts such as O-rings do not have to be added later in an additional step to seal the connector/cable interface connection from the environment. In addition, the connector can be installed in the normal manner in the field and without using special trim tools by taking the connector apart. Furthermore, the connector has no loose parts.

Connectors for radio frequency cables having annular corrugated outer conductors generally require a means to firmly grasp or secure the connector to the outer conductor of the cable. The RF cable has a annular corrugated outer conductor, a center conductor, and a dielectric foam between both conductors. The components of the one step connector include an outer conductor clamping back nut, a collet and a body. The collet (1) enhances electrical performance by providing a full 360 degree contact with the outer conductor (3). In addition, an O-ring is used to provide a seal between the back nut and outer conductor of the cable. The O-ring (4) provides an environmental seal by keeping moisture out.

The one step connector consists of three pieces—the collet (1), the back nut (2) and the body (5). The connector is assembled by screwing the back nut (2) and the body (5) together. The body (5) of the connector has an interior threaded portion at a first end having a thread depth and pitch to allow coupling with a threaded exterior portion of the back nut (2). The backnut (2) and body (5) have standard wrench flats for tightening the connector to the cable in the field.

A collet (1) having resilient fingers (13) sits in the interior portion (11) of the connector body (5). Its resilient fingers (13) extend into an interior surface of the back nut (2). FIG. 1 shows the collet (1) in the forward expanded position relative to the back nut (2). This position allows the collet to engage the cable's outer conductor (3) corrugations. The interior portion (11) of the connector body (5) also contains a taper (8) between the base and side of the connector body (5). The taper (8) is in contact with one end of the fingers (13) of the collet (1). The collet (1) also has a ramp (7) integrally formed into the midway of the fingers (13) which makes contact with the interior surface of the back nut.

Figure 2:
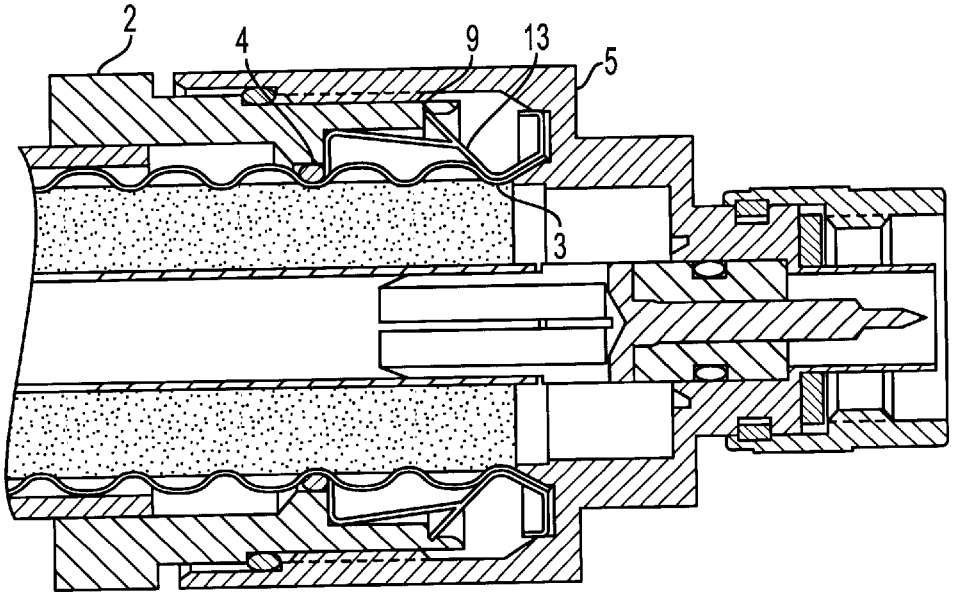
FIG. 2 is a view of the one step connector after being installed on the coaxial cable, i.e., the installed condition.

When the backnut (2) is mated with (or screwed into) the body (5), the collet (1) is forced further into the interior portion (11) of the connector body (5). See FIG. 2. Since the collet can not enter the back nut (2) in the expanded condition, the resilient fingers (13) of the (1) collet are forced to close (or collapse). Both the taper (8) of the connector in contact with one end of the fingers (13) and the ramp (7) located about midway on the fingers (13) in contact with the interior surface of the back nut (2) provide an inward radial force to force the resilient fingers (13) of the (1) collet to collapse (or close) radially. As a result, the formed ends of the independent resilient fingers (13) of the collet (1) close radially around the first corrugation groove of the outer conductor (3). (In effect, the collet functions like a spring-like lock washer and holds the connector to the cable.)

Furthermore, the collet comprises a tab (9) which engages a shoulder (10) of the back nut (2) just before the collet is fully inside the back nut (2). The shoulder provides the necessary rigidity to the collet in the clamped position by effectively reducing the overall length to thickness ratio of the resilient fingers (13) by about a 2:1 ratio.

In addition, an O ring (4), that initially resides in a cavity (12) created by the collet (1) and the back nut (2), is forced into a corrugation groove of the cable's outer conductor (3). (In a preferred embodiment, the resilient fingers (13) of the collet (1) are rigid enough to push the O-ring (4) out of the cavity). A bore (6) on the back nut (2) provides the proper diameter to compress the O-ring (4) to provide a tight seal. In a preferred embodiment, the connector uses an oversized O-ring that can be highly compressed as the connector is clamped to the cable. The O-ring has a high degree of compression so that the one step connector can fit over cables with normal tolerance variations. The O-ring can be compressed up to about half of the cross section in this embodiment. In summary, when the unit is screwed together, the O-ring (4) moves into a groove of the outer conductor and the collet (1) moves into the end groove of the outer conductor (3).

In a preferred embodiment, the front portion, or free end, of the resilient fingers (13) are bent outward to provide a cutting guide to trim the cable in the event the installer does not have the proper trim tool. In addition, the outward bend allows the fingers (13) to make contact with the body (5) of the connector to provide rigidity to the fingers (13) in the clamped position.

While the invention has been disclosed in this patent application by reference to the details of preferred embodiments of the invention, it is to be understood that the disclosure is intended in an illustrative rather than in a limiting sense, as it is contemplated that modification will readily occur to those skilled in the art, within the spirit of the invention and the scope of the appended claims and their equivalents.

What is claimed is:

1. A one step connector, comprising:

a body;

a backnut threadably attached to said body;

a collet seated in said body having resilient fingers which close radially; and an O-ring, wherein said O-ring initially resides in a cavity located between said collet and said backnut, whereby said resilient fingers push said O-ring from said cavity when said backnut is threadably attached to said body.

2. The connector according to claim 1, wherein said body comprises a first end with a threaded interior portion; and said back nut comprises a threaded exterior portion.

3. The connector according to claim 1, wherein said body further comprises a taper between a base and a side of said body, whereby said taper on said body closes said resilient fingers radially by pressing on an end of said resilient fingers.

4. The connector according to claim 1, wherein said collet further comprises a ramp located about midway of said resilient fingers, whereby said ramp makes contact with an interior surface of said back nut and closes said resilient fingers.

5. The connector according to claim 1, wherein said collet further comprises a tab and said back nut further comprises a shoulder, whereby said shoulder provides rigidity to said collet by engaging said tab of said collet.

6. The connector according to claim 1, wherein said O-ring is lubricated and oversized, whereby said O-ring passes freely over a cable, whereby said resilient fingers push said O-ring from said cavity to a corrugation groove in a cable's outer conductor when said backnut is threadably attached to said body.

7. The connector according to claim 1, wherein said back nut further comprises a bore, whereby said bore compresses said O-ring when said connector is clamped to a cable.

8. The connector according to claim 3, wherein said collet further comprises a ramp located about midway of said resilient fingers and a tab;

wherein said body comprises a first end with a threaded interior portion;

wherein said O-ring is oversized;

wherein said resilient fingers push said O-ring from said cavity to a corrugation groove in a cable's outer conductor when said backnut is threadably attached to said body; and wherein said back nut comprises a threaded exterior portion, an interior surface, a shoulder and a bore, whereby said ramp makes contact with an interior surface of said back nut and closes said resilient fingers, said shoulder provides rigidity to said collet by engaging said tab of said collet, and said bore compresses said O-ring when said connector is clamped to a cable.

9. The connector according to claim 1, wherein said connector is radio frequency coaxial cable connector.

10. A method of sealing a connector to a cable, comprising the steps of:

mating a backnut with a body;

closing a collet around a first corrugation groove of a cable's outer conductor; and pushing an O-ring from a cavity located between said collet and said backnut to a corrugation groove in said cable's outer conductor.

11. The method according to claim 10, wherein resilient fingers of said collet push said O-ring from said cavity.

12. The method according to claim 10, wherein said step of closing said collet comprises closing resilient fingers of said collet radially.

13. The method according to claim 10, further comprising the step of providing rigidity to said collet.

14. The method according to claim 10, further comprising the step of compressing said O-ring after it is pushed from said cavity.

15. The method according to claim 12, wherein a taper on said body collapses resilient fingers of said collet radially by pressing on at least one end of said resilient fingers.

16. The method according to claim 12, wherein a ramp on resilient fingers of said collet in contact with an interior surface of said backnut collapses said resilient fingers radially.

17. The method according to claim 12, further comprising a tab of said collet engaging a shoulder of said backnut, whereby a length to thickness ratio of said resilient fingers is reduced.

18. The method according to claim 13, wherein said rigidity is provided to said collet by a shoulder of said backnut engaging a tab of said collet.

19. The method according to claim 14, wherein said O-ring is compressed by a bore on said back nut.

20. The method according to claim 11, further comprising the steps of:

closing resilient fingers of said collet radially;

providing rigidity to said collet by a shoulder of said backnut engaging a tab of said collet; and compressing said O-ring after it is pushed from said cavity.

21. The method according to claim 10, further comprising the step of clamping said connector to a coaxial cable having an annular corrugated outer conductor.

22. A coaxial cable assembly, the assembly comprising:

a RF coaxial cable, comprising:

an annular corrugated outer conductor;

a center conductor; and a dielectric material between said outer conductor and said center conductor; and a one step connector attached to one end of said RF coaxial cable, comprising:

an outer conductor clamping backnut;

a body threadably attached to said backnut;

a collet seated in said body having resilient fingers which close radially; and an O-ring, wherein the O-ring initially resides in a cavity located between said collet and said backnut, whereby said resilient fingers push said O-ring from said cavity when said backnut is threadably attached to said body.

23. The assembly according to claim 22, wherein said body comprises a first end with a threaded interior portion; and said back nut comprises a threaded exterior portion.

24. The connector according to claim 22, wherein said body further comprises a taper between a base and a side of said body, whereby said taper on said body closes said resilient fingers radially by pressing on an end of said resilient fingers.

25. The connector according to claim 22, wherein said collet further comprises a ramp located midway of said resilient fingers, whereby said ramp makes contact with an interior surface of said back nut and closes said resilient fingers.

26. The connector according to claim 22, wherein said collet further comprises a tab and said back nut further comprises a shoulder, whereby said shoulder provides rigidity to said collet by engaging said tab of said collet.

27. The connector according to claim 22, wherein said O-ring is lubricated and oversized, whereby said O-ring passes freely over a cable, whereby said resilient fingers push said O-ring from said cavity to a corrugation groove in said cable's outer conductor when said backnut is threadably attached to said body.

28. The connector according to claim 22, wherein said back nut further comprises a bore, whereby said bore compresses said O-ring when said connector is clamped to a cable.

29. The connector according to claim 24, wherein said collet further comprises a ramp located about midway of said resilient fingers and a tab;

wherein said body comprises a first end with a threaded interior portion;

wherein said O-ring is oversized;

wherein said resilient fingers push said O-ring from said cavity to a corrugation groove in said cable's outer conductor when said backnut is threadably attached to said body; and wherein said back nut comprises a threaded exterior portion, an interior surface, a shoulder and a bore, whereby said ramp makes contact with an interior surface of said back nut and closes said resilient fingers, said shoulder provides rigidity to said collet by engaging said tab of said collet, and said bore compresses said O-ring when said connector is clamped to a cable.

* * * * *